United States Patent [19]

Kroetsch

[11] Patent Number: 4,848,622

[45] Date of Patent: Jul. 18, 1989

[54] DRINKING DEVICE FOR THE DISABLED

[76] Inventor: James Kroetsch, 3134 Maumee Trail, Port Huron, Mich. 48060

[21] Appl. No.: 280,544

[22] Filed: Dec. 6, 1988

[51] Int. Cl.[4] ..... B25D 83/00; A61J 15/00

[52] U.S. Cl. ..... 220/90.4; 5/503; 128/898; 206/217; 215/1 A; 248/291; 248/311.2; 604/78

[58] Field of Search ..... 5/1, 503, 508, 509, 5/512; 128/898; 206/217; 215/1 A; 220/90.2, 90.4; 248/103, 202.1, 214, 225.31, 230, 231.4, 231.8, 274, 291, 292.1, 311.2, 313; 604/77, 78

[56] References Cited

U.S. PATENT DOCUMENTS

| | | | |
|---|---|---|---|
| 103,299 | 5/1870 | Chapin . | |
| 455,452 | 7/1891 | Murray . | |
| 2,797,962 | 7/1957 | Best . | |
| 2,893,675 | 7/1959 | Smith et al. . | |
| 2,912,205 | 11/1959 | Toune . | |
| 2,969,064 | 1/1961 | Metz . | |
| 3,734,439 | 5/1973 | Wintz | 248/311.2 |
| 3,842,981 | 10/1974 | Lambert . | |
| 4,196,747 | 4/1980 | Quigley et al. . | |
| 4,291,814 | 9/1981 | Conn . | |
| 4,463,859 | 8/1984 | Greene | 248/103 |
| 4,699,318 | 10/1987 | Donatello et al. . | |

FOREIGN PATENT DOCUMENTS

| | | | |
|---|---|---|---|
| 0375560 | 6/1932 | United Kingdom | 220/90.2 |
| 1018820 | 2/1966 | United Kingdom | 220/90.2 |

*Primary Examiner*—Jimmy G. Foster

*Attorney, Agent, or Firm*—Harness, Dickey & Pierce

[57] ABSTRACT

A device for enabling a disabled person to drink liquid from a container when the person is confined to a bed having rails on opposite sides of a tiltable mattress. A bracket is removably connected to one of the rails and carries a container which is pivotally connected to the bracket about a horizontal axis. An arm is pivotally connected to the bracket about a vertical axis and holds a straw thereon such that one end of the straw is accessible by the patient and the other end is in the liquid in the container. The container pivots about the horizontal axis when the mattress is tilted to maintain the container in an essentially vertical orientation to prevent spillage. The arm can be pivoted about the vertical axis towards the patient to present the straw for drinking and pivoting away from the patient when finished.

9 Claims, 2 Drawing Sheets

DRINKING DEVICE FOR THE DISABLED

BACKGROUND OF THE INVENTION

1. Technical Field

This invention relates to drinking apparatus and, more particularly, towards a device that enables a disabled person to consume liquids while confined to a bed.

2. Discussion

Among the many problems confronting a disabled person is the problem of drinking liquids while the person is confined as a patient in a hospital bed. This is especially true when the disabled person has lost the use of his/her arms.

The patent literature contains several prior patents which relate to the general concept of drinking devices. They include:

| Patent No. | Inventor(s) |
|---|---|
| 103,299 | Chapin |
| 455,452 | Murray |
| 2,797,962 | Best |
| 2,893,675 | Smith et al. |
| 2,912,205 | Toune |
| 2,969,064 | Metz |
| 3,842,981 | Lambert |
| 4,196,747 | Quigley et al. |
| 4,291,814 | Conn |
| 4,699,318 | Donatello et al. |

While many of these patents attempt to solve some of the problems associated with drinking devices for invalids, there still exists a need for an economical yet effective drinking device as provided by the present invention.

SUMMARY OF THE INVENTION

Pursuant to the teachings of the present invention, a device is provided for enabling a disabled person to drink liquid from a container when that person is confined to a bed device includes a bracket connected to one of the rails and a container pivotally connected to the bracket about a horizontal axis. An arm is provided that is pivotally connected to the bracket about a vertical axis. The device includes means for holding a straw on the arm such that one end is accessible by the patient and the other end is inserted into the container. The container pivots about the horizontal axis when the mattress is tilted to maintain the container in essentially a vertical orientation to prevent spillage. The arm can be pivoted about the vertical axis toward and away from the patient for drinking from the straw and to move the straw away from the patient when he or she is done drinking.

BRIEF DESCRIPTION OF THE DRAWINGS

The various advantages of the present invention will become apparent to those skilled in the art after a study of the following specification and by reference to the drawings in which.

DESCRIPTION OF THE PREFERRED EMBODIMENT

Figure 3:
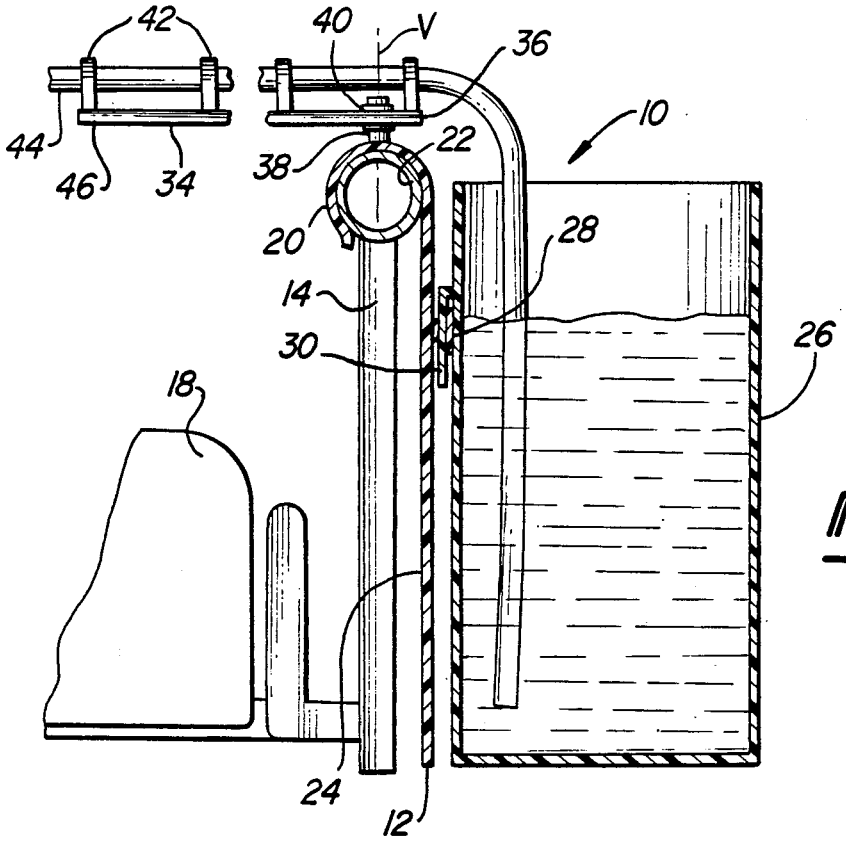
FIG. 3 is a cross-sectional view through the device and portions of the bed including the mattress and side rail.
Figure 4:
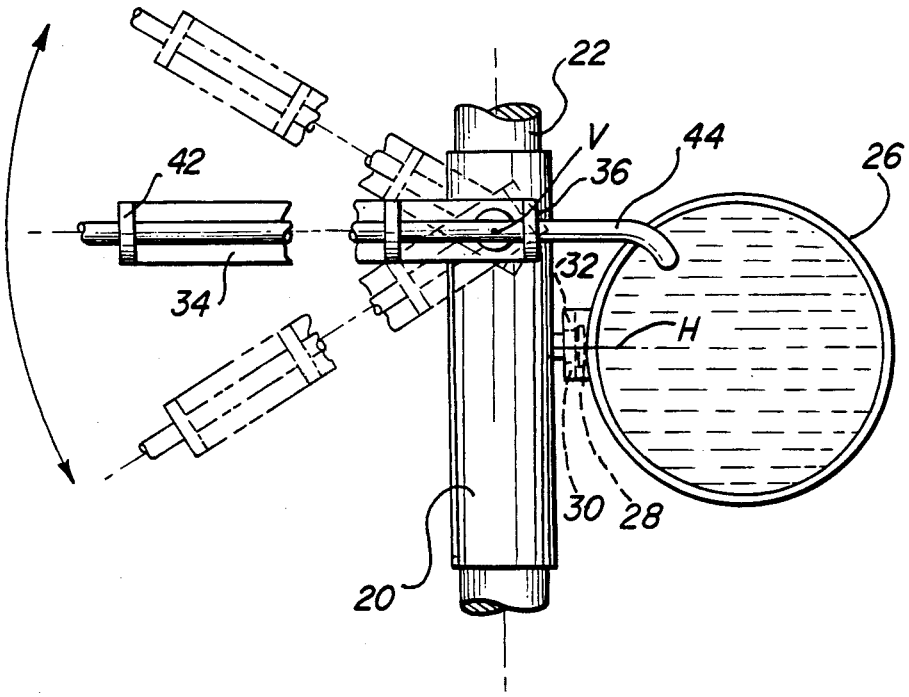
FIG. 4 is a top plan view looking down at the device as attached to the side rail.

Turning now to the drawings, there is a drinking device 10 made in accordance with the teachings of this invention. Device 10 includes a bracket 12 connected to a side rail 14 of a hospital bed 16 with a pivotal mattress 18. The bracket 12 can be connected to side rail 14 in a variety of manners. In the preferred embodiment, bracket 12 includes a reversely curled lip portion 20 designed to be press fit over the The bracket further includes a plate portion 24 that depends from lip 20 so that it extends downwardly generally parallel to the side rail 14 as can be seen most clearly in FIG. 3. A container 26 is pivotally connected to the plate portion 24 of bracket 12 about a horizontal axis H. This pivotal connection can be made in a variety of ways. In the illustrated embodiment, bracket 12 includes a horizontally extending button 28 over which downwardly depending forked legs 30 and 32 straddle. This pivotal connection enables the container 26 to pivot relative to the bracket 12 and to be removably connected thereto for easy refilling, cleaning, etc.

An elongated arm 34 is pivotally connected at the proximate end 36 to bracket 12 about a vertical axis V. Again, this pivotal connection can be made in a variety of ways. In the drawings, a pin 38 extends from the lip portion 20 of the bracket 12 through an opening in a bushing 40 fixed to the arm 34.

The upper surface of arm 34 carries means 42 for holding a flexible tube or straw 44. The straw 44 extends from the distal end 46 of arm 34 and is accessible by the patient, while the opposite end of the straw 44 extends into the container 26. Means 42 can take a variety of forms. In the preferred embodiment, this function is provided by a series of upright tabs having openings therein through which the straw 44 is threaded.

While the device 10 can be made of a variety of materials, its construction lends itself to being made from a high quality plastic material possessing lightweight yet rugged characteristics which can also be cleaned to hospital standards.

Figure 1:
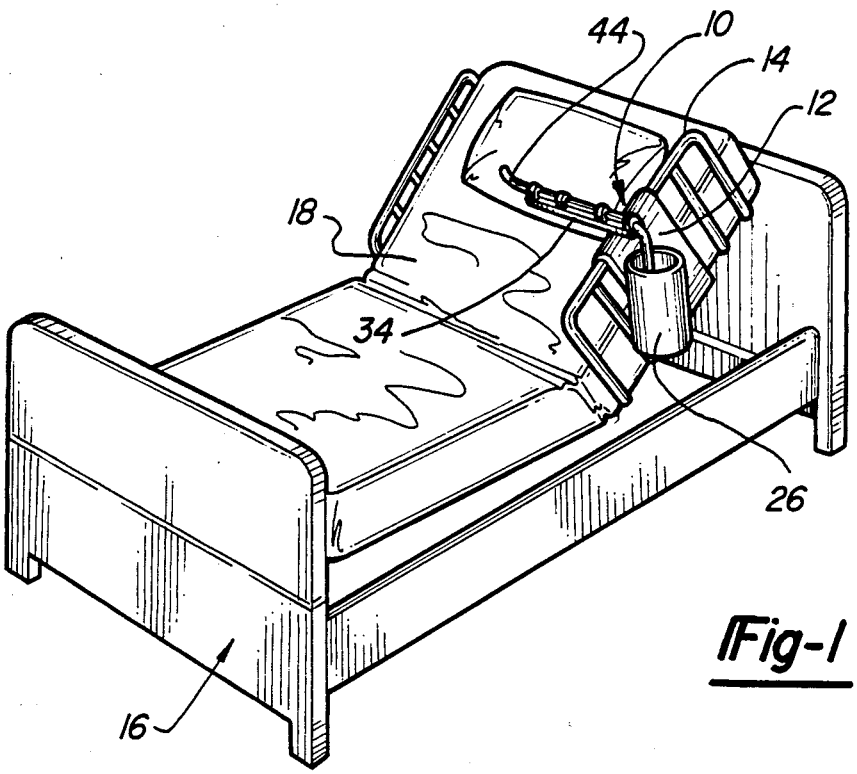
FIG. 1 is a perspective view showing a device made in accordance with the teachings of the present invention in use on a hospital bed with the mattress tilted.
Figure 2:
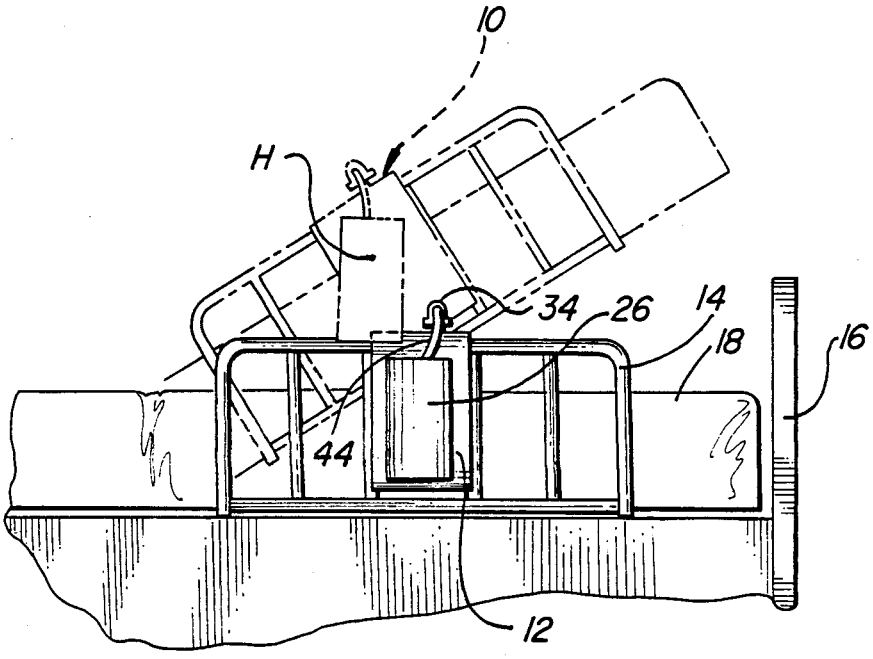
FIG. 2 is a side view showing that the container maintains its vertical orientation during raising and lowering of the mattress.

In use, the container 26 is filled with water or other liquid for the patient who is confined in the bed 16. The present invention finds particular utility for disabled persons who do not have use of their arms. If the person wishes to drink, she would typically raise the mattress 18 to the position shown in FIG. 1. The container 26 pivots about the horizontal axis H as shown in FIG. 2 so that it therein. Depending upon the disability of the patient, the arm 34 is manipulated either by the patient or by someone else to the position shown in FIG. 1 where the end of the straw 44 can be grasped by the mouth of the patient. Since the patient is sitting in a somewhat upright position the task of sucking and receiving liquid from the straw 44 becomes a much easier task than if the patient were to remain in a prone position. When the patient stops sucking on the straw, the liquid likewise stops flowing from the container almost immediately since the liquid remains below the level of the distal end of the straw. This avoids leakage problems that are sometimes created when a patient sucks from a pitcher that is located above her head level, such as having the pitcher placed on an adjacent bed stand.

When the patient is finished drinking, she can easily move the arm 34 out of the way by pivoting it about the vertical axis V. It is an easy task to refill the container 26 by lifting it from the pivot button 28 so that the container can be carried to a water fountain or the like for replenishing the supply of liquid. Then the container can be reattached to the bracket 12 by sliding the forked legs 30, 32 back over the pivot button 28.

It should be understood that while this invention has been described in connection with a particular example thereof, that those skilled in the art will realize that other modifications can be made after having the benefit of studying the specification, drawings and following claims.

What is claimed is:

1. A device for enabling a disabled person to drink liquid from a container when the person is confined to a bed having a side rail on one side of a tiltable mattress, said device comprising:

a bracket removably connected to the rail;

a container for liquid pivotally connected to the bracket about a generally horizontal axis;

an arm pivotally connected to the bracket about a generally vertical axis;

means for holding a straw on the arm such that one end of the straw is near a distal end of the arm and is accessible by the patient while the other end of the straw is in the container; and whereby the container pivots about the horizontal axis when the mattress is tilted to thereby maintain the container in essentially a vertical orientation to prevent spillage of the liquid and wherein the arm can be pivoted about the vertical axis towards the person for drinking from the straw, with the arm being easily pivoted away from the patient towards the rail when the person is finished drinking from the straw.

2. The device of claim 1 wherein said bracket includes an upper reversely curled portion disposed over a horizontal bar of the side rail.

3. The device of claim 2 wherein the reversely curled portion is press fit over the horizontal bar.

4. The device of claim 1 wherein the bracket further includes a substantially vertically depending plate portion; and wherein said plate portion has horizontal pivot means therein cooperating with the container to provide relative movement therebetween about said horizontal axis.

5. The device of claim 4 wherein said horizontal pivot means comprise:

a button extending from the plate portion of the bracket;

a pair of depending forked leg portions on the container arranged to slideably engage the button so that the container is pivotable about the axis of the button and removable from the bracket.

6. The device of claim 1 wherein said means for holding straw comprise a series of tabs having openings therein through which the straw is threaded.

7. A device for enabling a disabled person to drink liquid from a container when the person is confined to a bed having a side rail on one side of a tiltable mattress, said device comprising:

a plastic bracket having a reversely curled upper portion designed to be press fit about a horizontal bar of the side rail, said bracket having a vertically depending plate portion with a button extending therefrom about a horizontal axis;

a container for the liquid having a pair of downwardly depending forked legs cooperating with the button to permit the container to be pivotally moved relative to the bracket and to be removably attached thereto;

an arm pivotally connected at a proximal end thereof about a vertical axis to the reversely curled top portion of the bracket;

a series of tabs on the arm with openings therein; and a straw threaded through the openings in the tabs such that a distal end of the straw extends from a distal end of the arm while the other end of the straw extends into the container.

8. The device of claim 7 which is made of plastic material.

9. A method of providing drink to a disabled person when the person is confined to a bed having a side rail on one side of a tiltable mattress, said method comprising:

attaching a drinking device to the side rail of the bed, said drinking device having a bracket carrying a container which is pivotally connected about a horizontal axis to the bracket, with the bracket further supporting an arm pivotally connected about a vertical axis;

attaching a straw to the arm of the drinking device such that a one end of the straw extends from a distal end of the arm, while the other end of the straw extends into the liquid in the container;

tilting the mattress to an upright position, with the container pivoting about the bracket to prevent spillage of the liquid;

pivoting the arm towards the head of the patient so that the one end of the straw can be sucked by the patient to obtain liquid from the container; and pivoting the arm away from the patient when the patient is finished drinking.

* * * * *

UNITED STATES PATENT AND TRADEMARK OFFICE

CERTIFICATE OF CORRECTION

PATENT NO. : 4,848,622

DATED : July 18, 1989

INVENTOR(S) : James Kroetsch

It is certified that error appears in the above-identified patent and that said Letters Patent is hereby corrected as shown below:

Col. 1, line 42, insert --having rails on opposite sides of a tiltable mattress. The-- after "bed".

Col. 2, line 16, insert --horizontal bar 22 of the side rail 14.-- after "the".

Col. 2, line 56, insert --essentially remains vertical to prevent spillage of the liquid-- after "it".

Signed and Sealed this

Twenty-eighth Day of August, 1990

*Attest:*

HARRY F. MANBECK, JR.

*Attesting Officer*

*Commissioner of Patents and Trademarks*